US007021910B1

(12) United States Patent
Huang et al.

(10) Patent No.: US 7,021,910 B1
(45) Date of Patent: Apr. 4, 2006

(54) SOLAR ENERGY OPERATED AIR PUMP

(76) Inventors: Jen-Yao Huang, P.O. Box 697, Feng-Yuan City, Taichung Hsien (TW) 420; Se-Chiang Hsiao, P.O. Box 697, Feng-Yuan City, Taichung Hsien (TW) 420

( * ) Notice: Subject to any disclaimer, the term of this patent is extended or adjusted under 35 U.S.C. 154(b) by 441 days.

(21) Appl. No.: 10/602,822

(22) Filed: Jun. 25, 2003

(51) Int. Cl.
*F04B 17/03* (2006.01)

(52) U.S. Cl. ..... 417/411; 417/412

(58) Field of Classification Search ..... 417/411, 417/412, 413.1, 472, 473
See application file for complete search history.

(56) References Cited

U.S. PATENT DOCUMENTS 2,960,321 A * 11/1960 Stoots, Jr. ..... 417/411
3,216,650 A * 11/1965 Thyreen ..... 417/411
3,776,666 A * 12/1973 Ludwig ..... 417/411
3,910,725 A * 10/1975 Rule ..... 417/411
4,331,883 A * 5/1982 Vitaloni ..... 417/411
4,375,162 A * 3/1983 Eppley ..... 417/411
5,480,590 A * 1/1996 Neshat et al. ..... 417/411
6,712,586 B1 * 3/2004 Koyano et al. ..... 417/411

FOREIGN PATENT DOCUMENTS

DE 3440978 A1 * 5/1986

* cited by examiner

*Primary Examiner*—Michael Koczo, Jr.

(57) ABSTRACT

A solar energy operated air pump includes a rectangular box having a lower lid connected to the bottom, an upper lid openably covering the top thereof and a solar cell inlaid into the upper lid protected by a layer of transparent painting. Inside the box there are a battery chamber containing spare batteries, a motor having an axis connected to an eccentric cam which respectively pivoted to a pair of push rods. The push rods each has a push plate on free end respectively engaged with a pair of air extractors each of which has an air vessel symmetrically connected to the opposing side walls of the box and each of the air vessels has an air inlet and an air outlet, a three steps switch respectively connected to the motor, the solar cell and the battery chamber. When the motor is operated either by the solar cell or by the batteries, the air extractors pressed by the push plate begins to supply fresh air into the water in a pair through a pair of hoses.

2 Claims, 5 Drawing Sheets

SOLAR ENERGY OPERATED AIR PUMP

BACKGROUND OF THE INVENTION

The present invention relates to air pumps and more particularly to a solar energy operated air pump for a fisherman fishing at riverside, beach or of the sea requires a pail containing water to input the baits and/or the fishes he caught. And an air pump is needed to supply with the fresh air into the water in order to keep the fishes alive and fresh. The conventional air pump contains a motor operated only by batteries which can not last too along if the fisherman works all day and all night. The fishes and the baits are going to be dead when the pump stops to supply the fresh air into the pail containing water that causes great losses to the fisherman. If he carries a lot of spare batteries. It is inconvenient for him to change the battery.

SUMMARY OF THE PRESENT INVENTION

The present invention has a main object to provide a solar energy operated air pump in which a solar cell supplies the electricity to actuate a motor pump to rotate continuously without carrying spare batteries.

Another object of the present invention is to provide a solar energy operated air pump in which the solar cell is inlaid in an upper lid of a box so as to save space.

Accordingly, the solar energy operated air pump of the present invention comprises generally a box including an upper lid and a lower lid and a solar cell inlaid in the upper lid and protected by a transparent protection layer. Inside the box, there are a motor, at least an air extractor and a battery chamber. The motor has an axis to rotate a cam which actuates alternatively the push rods each includes a push plate to repeatedly press the air extractors to input the fresh air through an air inlet and to output the fresh air through an air outlet. A switch respectively connects to the motor, the solar cell and the battery chamber. The motor can be operated either by the solar cell in the sunny days or operated by the batteries in the cloudiness and night-time.

The present invention will become more fully understood by reference to the following detailed description thereof when read in conjunction with the attached drawings.

DETAILED DESCRIPTION OF THE PREFERRED EMBODIMENT

Figure 1:
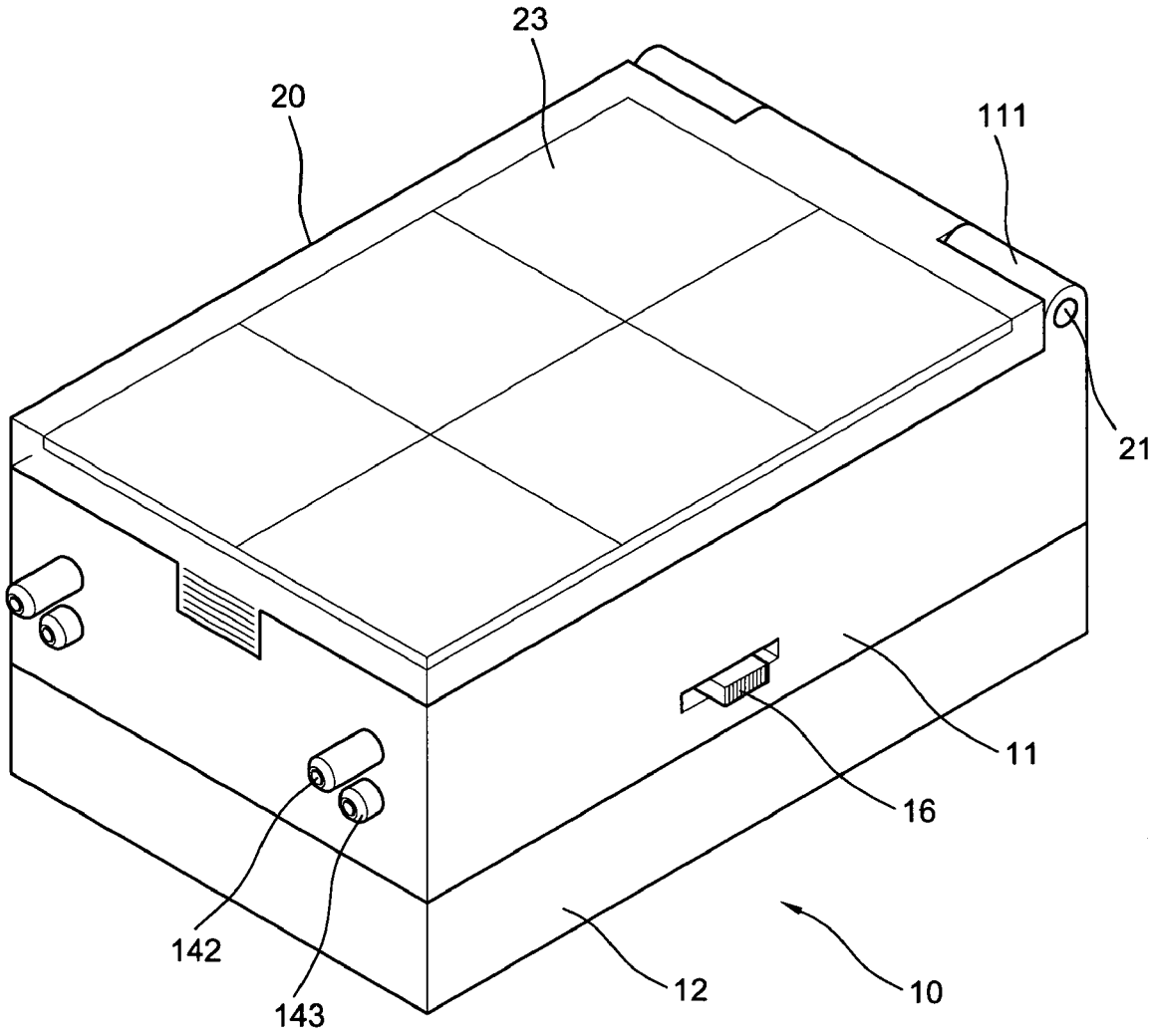
FIG. 1 is a perspective view to show the air pump of the preferred embodiment of the present invention.
Figure 2:
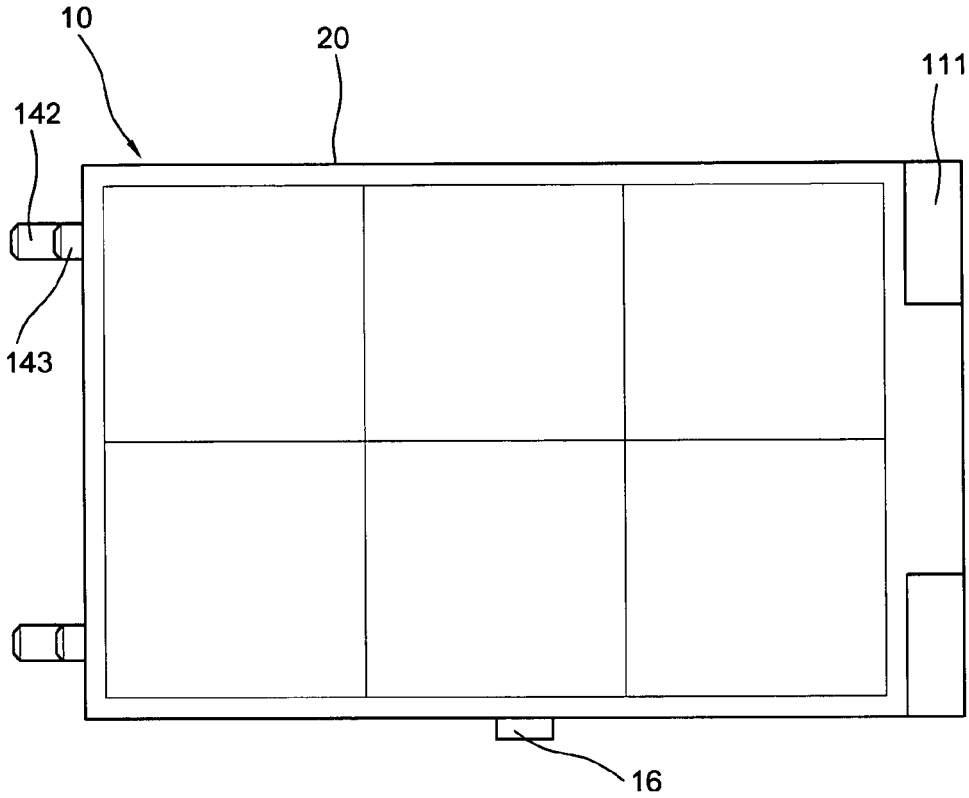
FIG. 2 is a top view of FIG. 1.
Figure 3:
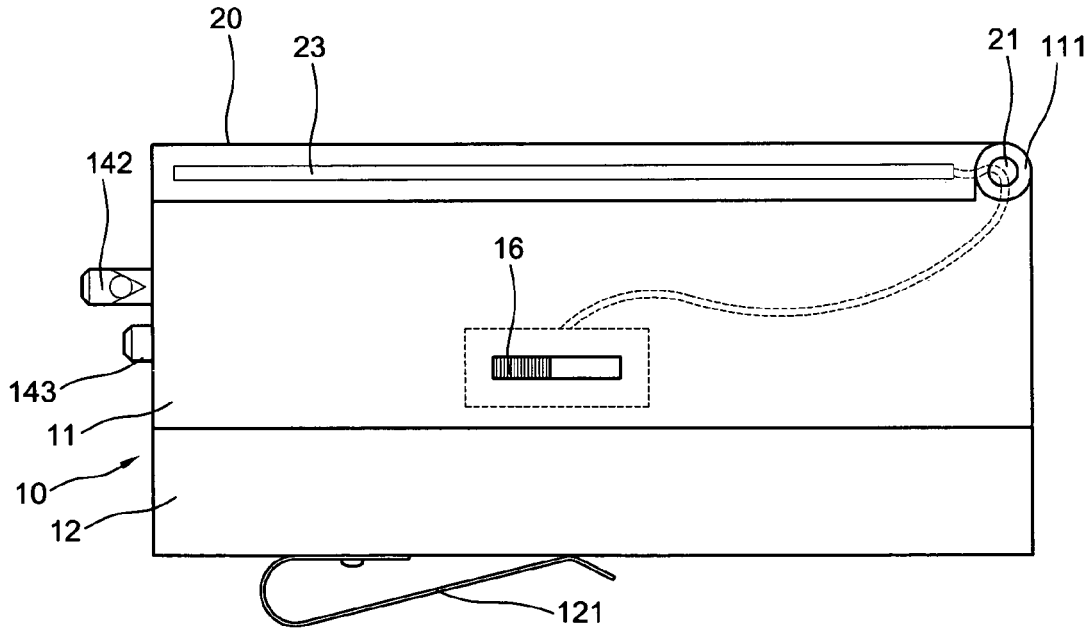
FIG. 3 is a side view of FIG. 1.
Figure 4:
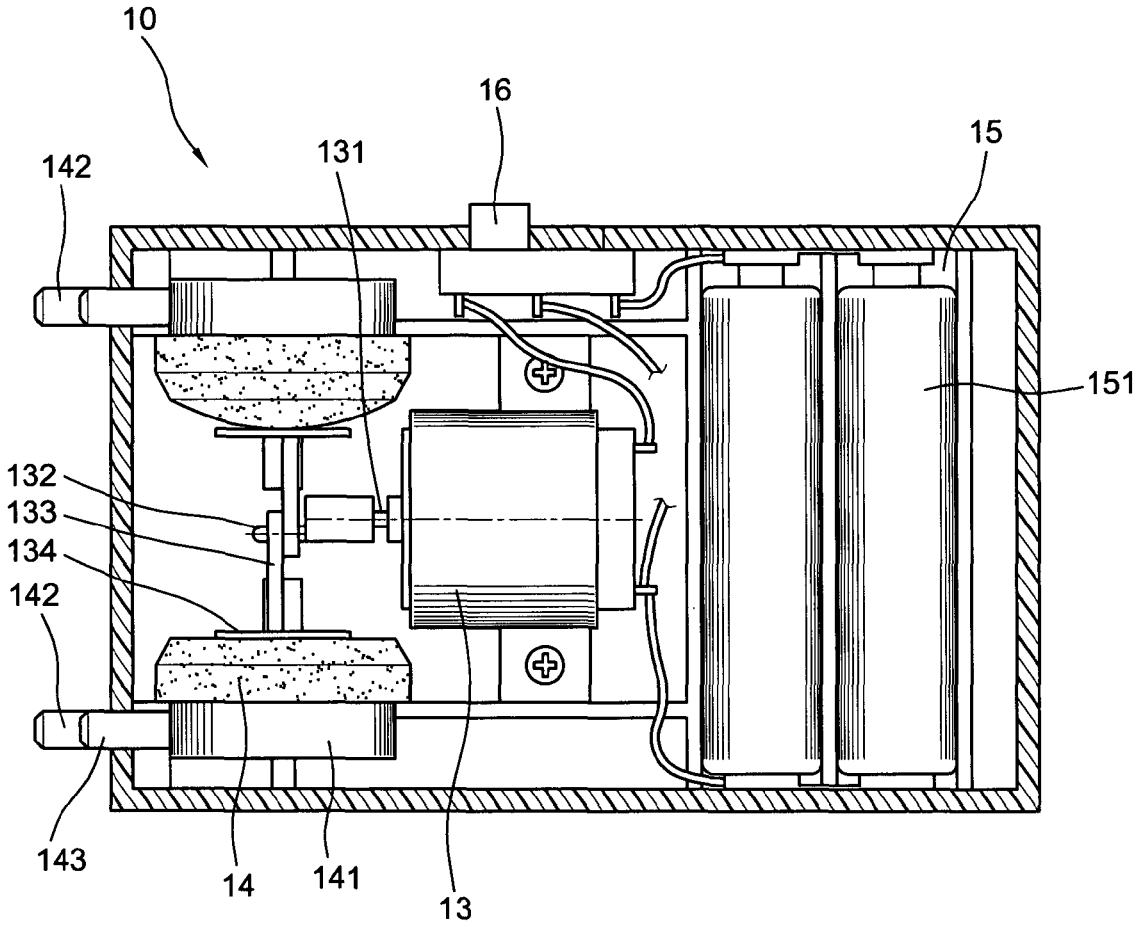
FIG. 4 is a sectional view to show the components disposed inside the air pump.
Figure 5:
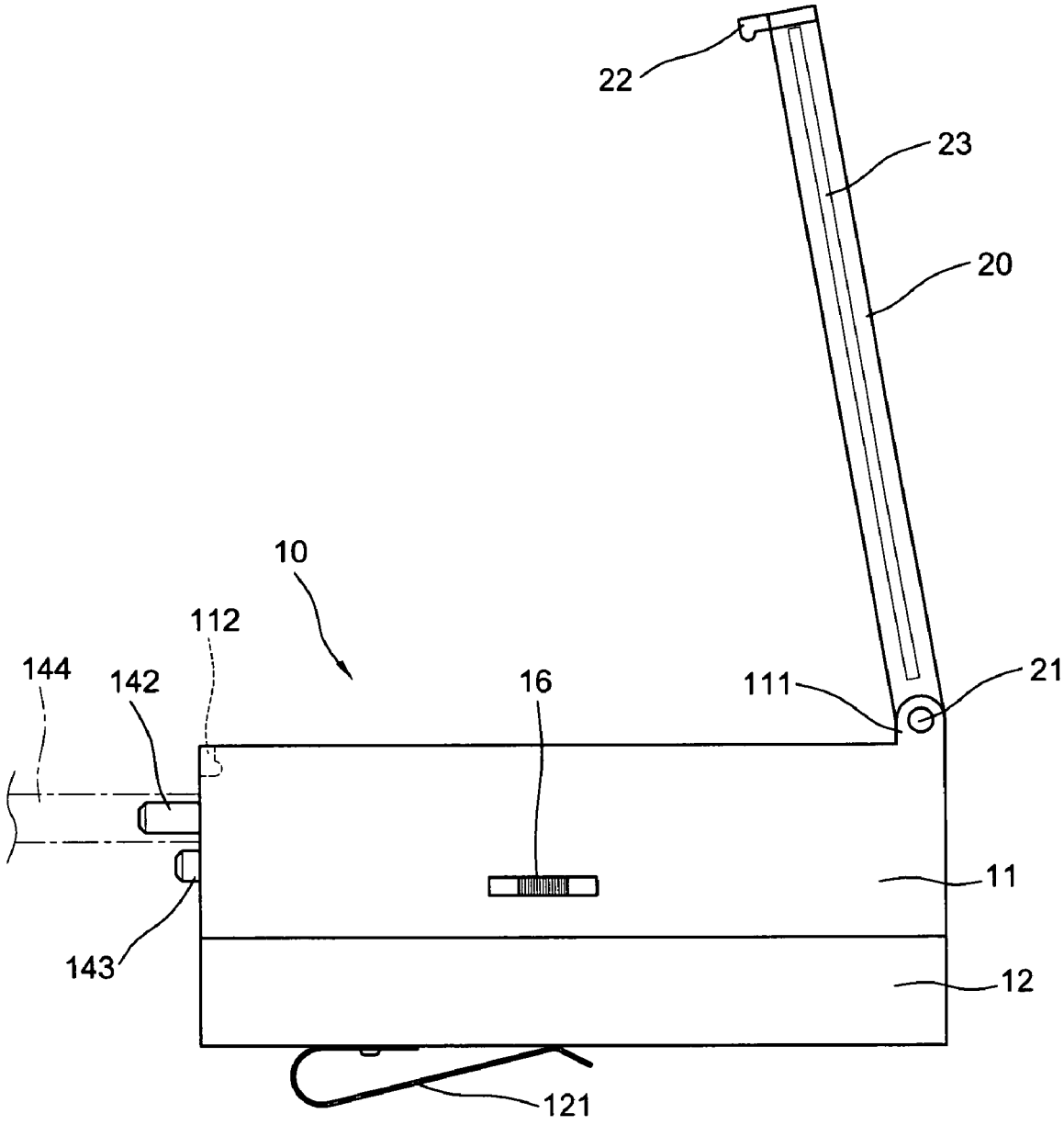
FIG. 5 is a side view to show that the upper lid is opening.

With reference to FIGS. 1 to 4 of the drawings, the solar energy operated air pump of the present invention which is designated as 10 and comprises a rectangular box 11, a lower lid 12 connected to the open bottom of the box, a pair of axle sleeves 111 symmetrically formed on the top of one end of the box 11, a locking slot 112 centrally formed in the top of the other end of the box 11, an upper lid 20 openably covering the open top of the box 11 and having a pair of axle pins 21 symmetrically formed on one end rotatably engaged within the axle sleeves 111 and a latch 22 centrally formed under the other end releasably engageable within the locking slot 112 (as shown in FIG. 5), and a flat solar cell 23 inlaid into the upper lid 20 and protected by a layer of transparent painting or a piece of transparent glass.

Figure 6:
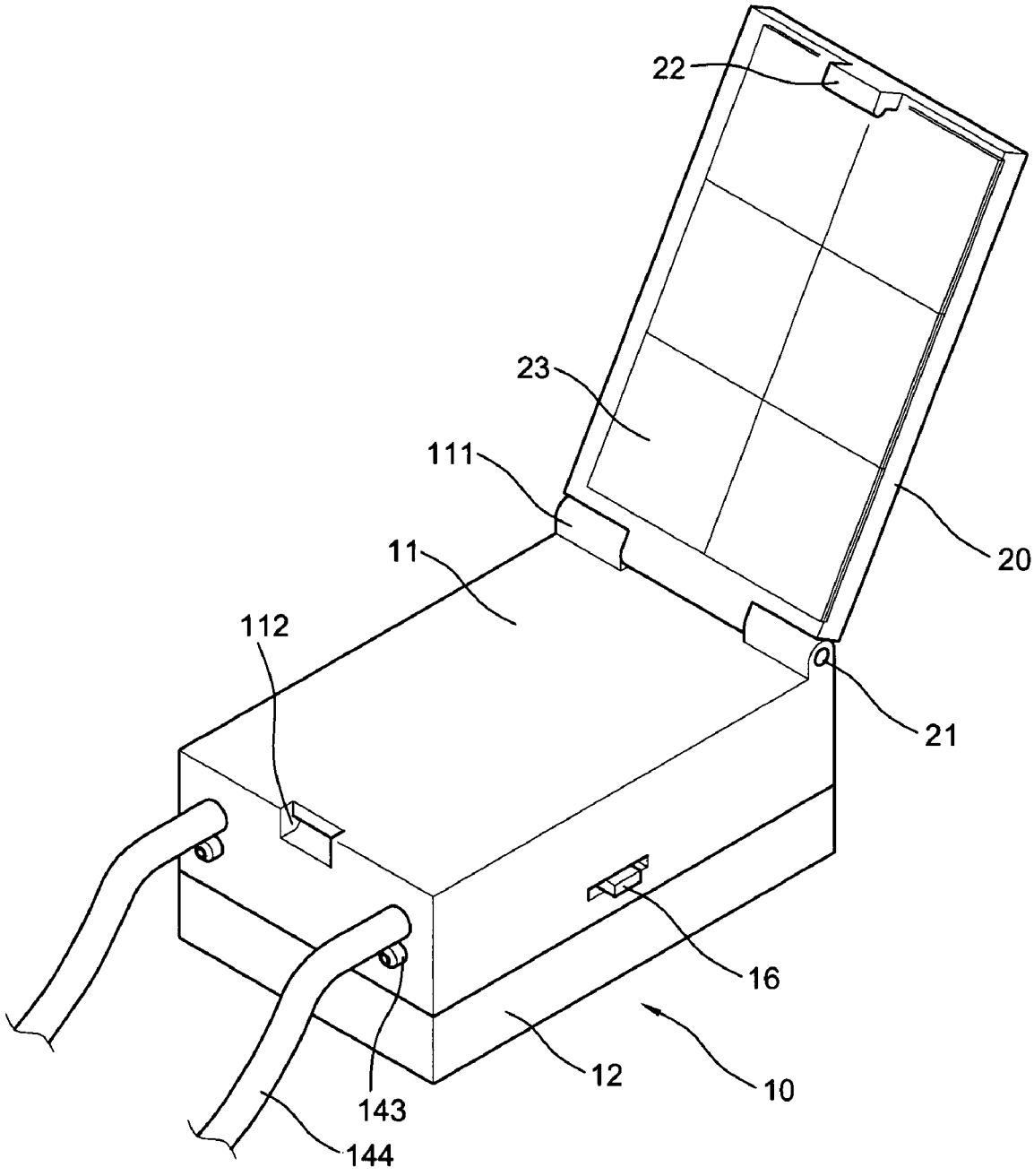
FIG. 6 is a perspective view to show that the upper lid is already opened and the solar cell begins to be effective.

Inside the box 11, there are a motor 13, a pair of air extractors 14, a battery chamber 15 and a switch 16 which protrudes to outside of the box 11. The motor has an axis 131 connected to an eccentric crank 132 which is in turn pivoted to a pair of push rods 133. Each of the push rods perpendicularly connected to a push plate 134. The push plates 134 press the air extractors 14 which are made of rubber so that they have the elasticity to restore immediately after deformed by the press of the push plates 134. The air extractors each has an air vessel 141 respectively connected to the opposing inner surfaces of the box 11 and each of the air vessels 141 has an air outlet 142 and an air inlet 143. Each of the air outlet 142 has a non-return valve to insure the fresh air flowing outward and each of the inlet 143 has also a reverse non-return valve to ensure the fresh air flowing into the air vessel without flowing backward. A pair of hoses connected respectively to the air outlets 142 and extended into the water in the pail (as shown in FIGS. 5 and 6) to supply the fresh air into the pail. The battery chamber 15 contains a pair of AAA spare batteries 151. The switch 16 is of three position type and respectively connects the motor 13 the solar cell 23 and the battery chamber 15 so that the switch can individually control the solar cell 23, the battery chamber 15 or shut out the electric power. A clip 121 is fastened on the outer surface of the lower lid 12 for enabling the air pump attached to the pants belt of the fisherman or other appropriate objects.

Based the above discussed structure and function, the upper lid 20 may open a predetermined angle or keep the lid 20 closed to let the solar cell toward the sun light to absorb the solar energy (as shown in FIGS. 5 and 6) in order to transmit electricity to rotate the motor 13 and the crank 132 which actuates the push rods 133 to slide about to press the air extractors 14 forcing the fresh air in the air vessels 141 flowing out of the outlet and to continuously supply the fresh air into the water in the pail to keep the fishes and baits alive.

The solar cell is adapted to various objects, by the manufacturers. But few of them used the solar cell in the air pump which provides great convenience to the fisherman. It provides endless solar energy in the sunny days. Besides, the addition of the solar cell in the air pump needs not to enlarge the volume of the pump but provides more convenience to the fisherman.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

We claim:

1. A solar energy operated air pump comprising:

a rectangular box having an open top, an open bottom, a pair of axle sleeves symmetrically formed on top of one end and a locking slot centrally formed in a top of other end thereof;

a lower lid connected to the open bottom of said box;

an upper lid openably covering the open top of said box and having a pair of axle pins symmetrically formed on one end respectively engaged with the axle sleeves of said box and a latch centrally formed under other end thereof releasably engaged within the locking slot of said box;

a flat solar cell being inlaid into said upper lid and protected by a layer of transparent means;

a battery chamber disposed on a bottom abutting one end of said box and containing a pair of AAA spare batteries therein;

a motor secured to a central bottom of said box having an axis connected to an eccentric crank which respectively pivoted to a pair of push rods and each of said push rods perpendicularly connected on a free end to a push plate;

a pair of air extractors engaged with said push plates each having an air vessel symmetrically connecting to an inner surface of opposing side walls of said box, said air vessels each having an air inlet and an air outlet extruding out of an end wall of said box opposite to said battery chamber, each of said air outlet having a non-return valve and each of said air inlet having a reverse non-return valve disposed therein;

a three position switch disposed on an inner surface of a side wall of said box extruding out of said box and respectively connected to said motor, said solar cell and said battery chamber through electric cords;

a clip secured to an outer surface of said lower lid; and a pair of hoses respectively connected to said air outlets and extending into a pail containing water for transmitting fresh air into the water from said air pump.

2. The solar energy operated air pump as recited in claim 1 wherein said air extractors are made of rubber.

* * * * *